United States Patent [19]

Eizonas

[11] 4,308,784

[45] Jan. 5, 1982

[54] CERAMIC PARTS FOR STRINGED MUSICAL INSTRUMENTS

[76] Inventor: Thomas S. Eizonas, P.O. Box 895, Etowah, N.C. 28729

[21] Appl. No.: 153,076

[22] Filed: May 27, 1980

[51] Int. Cl.[3] ..... G10D 3/04; G10D 3/06

[52] U.S. Cl. ..... 84/452 R; 84/307; 84/314 R; 84/314 N

[58] Field of Search ..... 84/297–299, 84/303, 307–309, 314, 452

[56] References Cited

U.S. PATENT DOCUMENTS

| | | | |
|---|---|---|---|
| 577,930 | 3/1897 | Prince | 84/314 N |
| 2,664,022 | 12/1953 | Maccaferri | 84/314 N |
| 3,081,662 | 3/1963 | Retter | 84/298 |
| 3,515,025 | 6/1970 | Appleton | 84/314 N |
| 3,538,233 | 11/1970 | Compton et al. | 84/307 X |
| 3,712,952 | 1/1973 | Terlinde | 84/314 R |
| 4,064,779 | 12/1977 | Petillo | 84/314 R |
| 4,064,780 | 12/1977 | Bond | 84/314 N |

FOREIGN PATENT DOCUMENTS

| | | | |
|---|---|---|---|
| 5142 | of 1896 | United Kingdom | 84/307 |

*Primary Examiner*—Lawrence R. Franklin

[57] ABSTRACT

An improved fret, nut and/or, bridge saddle for stringed instruments comprises a polished aluminum oxide ceramic. The ceramic of this invention is long lasting and provides improved tonal clarity, and can increase greatly the ease with which a strummed instrument can be played.

10 Claims, 10 Drawing Figures

CERAMIC PARTS FOR STRINGED MUSICAL INSTRUMENTS

BACKGROUND OF THE INVENTION

In the past, frets for stringed instruments such as guitars, banjos, mandolins, etc., were made of wood, ferrous metals, or resinous materials which could be natural or synthetic.

Each of the materials used to make frets before my invention had certain drawbacks. Wood and organic materials will wear readily with use, metals are prone to corrosion and wear, causing improper pitch, and also causing the strings to buzz. All these prior art frets must be replaced when worn. The replacement procedure is not only time consuming and expensive, but can also subject the neck of the instrument to damage. These drawbacks are overcome by my invention. Ceramics do not corrode and are highly abrasion-resistant. These characteristics are not found in wood, metalic or organic materials.

It is also known that bridges of stringed instruments which are played with a bow such as violins, viola, cellos, and bass fiddles wear out with use. Therefore, bridges made of the polished alumina ceramics in accordance with the invention can be substantially free of wear due to use and will not require replacement for very extended periods of time.

Thus, this invention is applicable to any stringed musical instrument which has a neck and a bridge, without or without a nut, and which is played either by strumming or by means of a bow.

BRIEF DESCRIPTION OF THE INVENTION

My invention comprises novel frets, bridge saddles and/or nuts, made of a polished aluminum oxide ceramic, for stringed musical instruments. As is well known to musicians who play fretted and non-fretted string instruments, the frets are those members or elements which are positioned on the fingerboard with proper spacing to effect a desired pitch of the string or strings when fingered in the proper manner while playing the instrument. The frets are positioned vertically so that the tops of the frets are slightly higher than the plane of the fingerboard. The nut is the part of the instrument adjacent to the outer edge of the fingerboard and near the tension adjusting screws. The nut serves to secure the strings against excessive sideward movement. The bridge saddle is located on the body of the instrument and serves to maintain the strings from contact with the body. Since all these elements of the instrument are directly related for producing the proper pitch, tone, and in the case of a strummed or picked instrument, the playability as well as such negative factors as wear and replaceability, two or all three of the elements are representative of my invention.

It is an object of this invention to provide stringed musical instruments with polished aluminum oxide frets.

It is still another object to provide a stringed musical instrument with a polished aluminum oxide bridge saddle.

It is yet another object to provide a stringed musical instrument with a polished aluminum oxide nut.

DETAILED DESCRIPTION OF INVENTION

Figure 1:
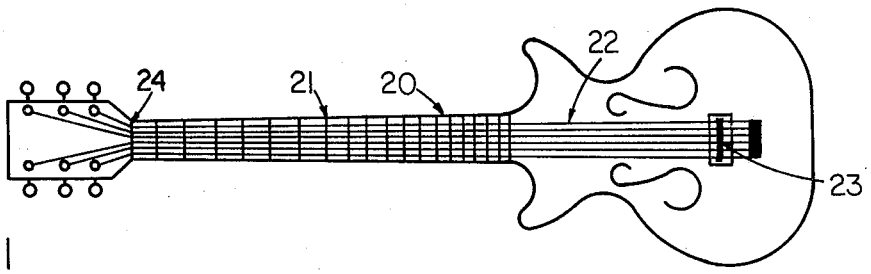
FIG. 1 is a plan view of a guitar, as a representative stringed musical instrument.

Alumina ceramics containing from about 75% to 100% alumina are well known industrial products. They are made by mixing aluminium oxide together with additives and are either wet milled or dry mixed together with a binder. The mixture can be extruded into proper shapes or cast or pressed under high pressure.

The additives which can be used include but are not necessarily limited to inorganic boron compounds, chromium compounds, magnesium compounds, silica compounds, phosphates, such as bentonite, kaolin, ball clays, fire clays, and any other clays well known for use in the ceramic industry. Other additives include zirconium compounds, iron compounds, alkaline earth metal compounds, manganese compounds, silicon dioxide and titanium compounds, calcium compounds, fluorspar, and various talcs.

Alumina ceramics and methods of their preparation are disclosed in a text entitled "Industrial Ceramics", 1963, F. Singer and S. S. Singer, Chemical Publishing Company., 212 Fifth Avenue, New York, N.Y., and in "The Technology of Ceramics and Refractories" P. O. Budinkov, The M.I.T. press, Cambridge, Mass. 1964. Especially pertinent is the material on pages 195–215 of the latter text.

The alumina ceramics of this invention have an alumina content of about 75% to 100%, Rockwell A hardness of at least about 60 to about 87, and particle size of about 5 to 30 microns. These ceramics are polished prior to use as frets, or bridges, for stringed musical instruments.

The polishing of the ceramic from which the frets are made is effected by the use of a hard polishing material such as diamond dust, silicon carbide dust, silicon nitride dust or any material having a hardness greater than Rockwell A 87. The frets may also be polished by standard tumbling procedures using various tumbling and polishing media.

For certain instruments such as guitars which have electrical amplifying systems, one or more of the frets can be plated in whole or in part so that it will conduct electricity. Typical plating metals are copper, zinc, tin, or aluminum.

In referring to the drawing a numeral when used on more than one view always represents a single element of the system.

In FIG. 1 which shows a guitar in a plan view, 20 represents the neck of the guitar, having a plurality of frets 21 spaced from each other and located below a set of strings 22 and perpendicular thereto. The strings 22 pass over a bridge saddle 23 and extend to a nut 24 at the section of the neck remote from the bridge saddle.

Figure 2:
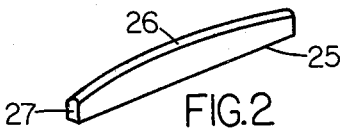
FIG. 2 is an isometric view of one type of fret.
Figure 3:
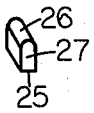
FIG. 3 is a cross section of the fret in FIG. 2.

In FIGS. 2 and 3, 25 represents the base of the fret 21, which is inserted into an opening in the neck. The top of the fret 26 usually has a slightly curved surface. The thickness 27 of the fret is substantially uniform in this modification.

Figure 4:
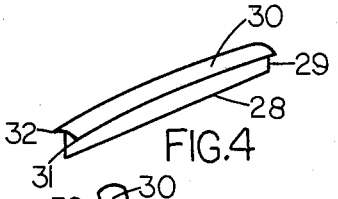
FIG. 4 is an isometric view of another type of fret.
Figure 5:
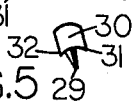
FIG. 5 is a cross section of the fret in FIG. 4.

In FIGS. 4 and 5, 28 shows the base of the fret which has a vertical portion 29 substantially uniform in thickness, but considerably thinner than the arcuate top 30. The flanges 31 and 32 of the top of the fret lie on or near the surface of the neck while the narrow section is inserted into a closely fitting slot in the neck.

Figure 6:
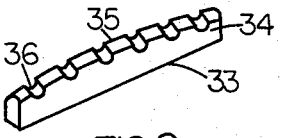
FIG. 6 is an isometric view of a nut.

The nut of FIG. 6 has a base 33 which is inserted into a slot in the neck 20 a vertical section 34 somewhat higher than the fret and an arcuate top portion 35 which has a series of openings 36 each of which accommodates a string of the instrument.

Figure 7:
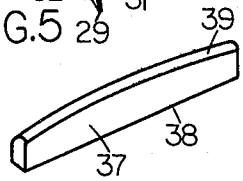
FIG. 7 is an isometric view of a bridge saddle.
Figure 8:
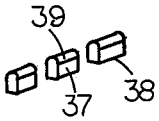
FIG. 8 is an isometric view of another form of bridge saddle.

The bridge saddle 37 of FIG. 7 which is representative of one form of such saddle, also has a substantially flat base 38 and an arcuate top 39. The height of the bridge saddle must be sufficient to permit the strings to ride above the frets when the instrument is in tune. FIG. 8 shows another type of bridge saddle.

It is to be understood that other bridge saddle designs, particularly those stringed instruments played with a bow can also be made of the alumina ceramics of this invention, even though they are not shown in the drawing.

Figure 9:
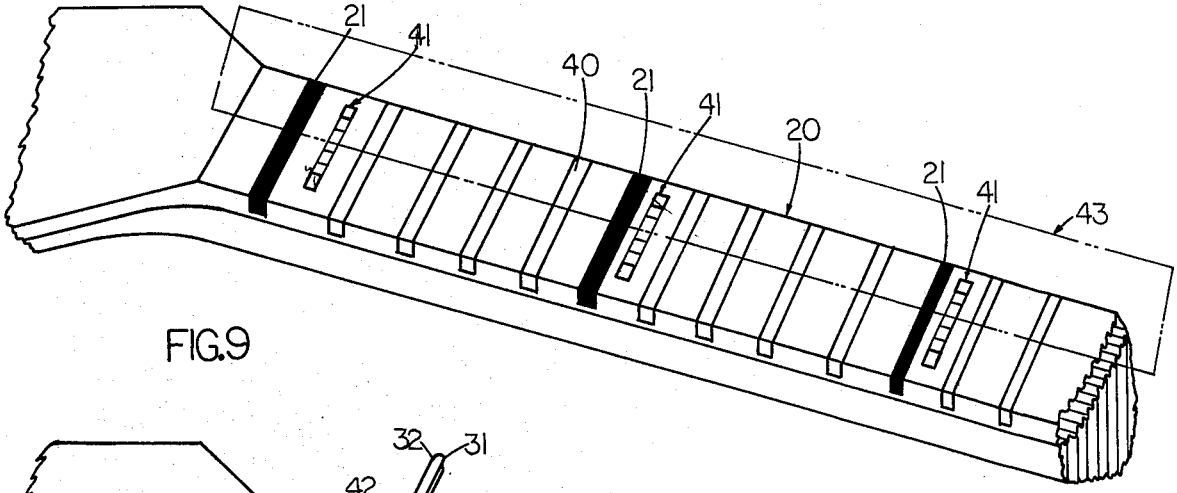
FIG. 9 is an isometric view of a guitar neck showing the installation of frets of FIG. 2.

The positioning of the fret of FIG. 2 onto the neck of an instrument is shown in FIG. 9. The frets are prepared to a width slightly narrower than a slot 40 in the neck 20 and slightly higher than the depth of the slot. An adhesive is applied either to the sides of the slot or to the base and sides of the fret. Two or more frets placed at spaced intervals are inserted into slots 40. One or more shims 41 having a predetermined thickness equal to the height that the fret will lie above the neck, are placed in the solid portions of the neck at spaced intervals and the frets are then forced into proper position with a straight edged tool, such as a ruler 43. After the first few frets are securely adhered, the remaining frets can be adhered to the neck without further use of the shims, because those already in place will serve as a guide to placement of the remaining frets.

Figure 10:
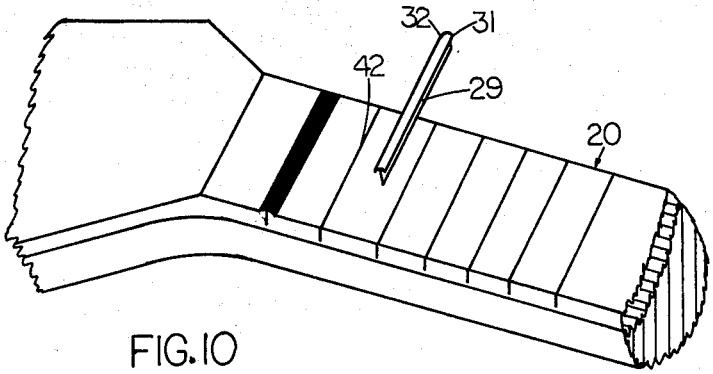
FIG. 10 is an isometric view of a guitar neck showing the installation of frets of FIG. 4.

For inserting the frets of FIG. 4, the slots 42 of FIG. 10 are slightly wider than the vertical portion 29 of the fret, and the overall length of the fret is substantially the same as width of the neck of the instrument. An adhesive is applied either to the slot 42 or the section 29 of the fret and then the fret is pushed into the slot 42 so that the flanges 31, 32, remain on the surface of the neck.

The nut and bridge saddle can be adhered to the instrument either by use of slots or by merely pressing onto an adhesive containing surface of the neck or body of the instrument, respectively.

Any adhesive which is not too sensitive to moisture can be used. Representative but not limiting types of adhesives include Phenol-aldehyde, phenol-urea, epoxy, vinyl acetate, vinyl-acetate butyrate, alpha cyanoacrylates, rubber adhesives and any other adhesive known to be water resistant.

It is understood that the above description is illustrative and is not intended to be a limitation on my invention, except as expressly provided in the appended claims.

I claim:

1. A stringed musical instrument element, which comes in contact with the strings of said stringed musical instrument, said element being an aluminium oxide ceramic containing from about 75% to about 100% aluminum oxide, having a particle size of from about 5 to about 30 microns, and a Rockwell A hardness of at least about 60 to about 87.

2. The element of claim 1 in which the aluminum oxide ceramic contains from about 90% to about 100% aluminum oxide.

3. The element of claim 2 which is a fret.

4. The element of claim 1 which is a fret.

5. An element according to claim 4 in which the thickness of the fret is substantially uniform from top to bottom.

6. The element according to claim 5 in which the ceramic has an alumina content of from 90% to 100%.

7. The element of claim 6 which the ceramic has an aluminum oxide content of from about 90% to about 100%.

8. The element according to claim 4 in which the fret has a narrow base and vertical wall and a pair of outwardly extending flanges at the top.

9. An element according to claim 1 which is a bridge saddle.

10. An element according to claim 1 which is a nut.

* * * * *